US006149146A

United States Patent [19]

Pleban

[11] Patent Number: 6,149,146

[45] Date of Patent: Nov. 21, 2000

[54] MACHINING VISE

[76] Inventor: Michael Pleban, 6471 Prospect Rd., San Jose, Calif. 95129

[21] Appl. No.: 09/299,386

[22] Filed: Apr. 27, 1999

[51] Int. Cl.[7] ..... B25B 5/00

[52] U.S. Cl. ..... 269/246; 269/201

[58] Field of Search ..... 269/246, 254 R, 269/268, 269, 270

[56] References Cited

U.S. PATENT DOCUMENTS 3,236,516 2/1966 Young ..... 269/252
3,752,466 8/1973 Johnson ..... 269/201

*Primary Examiner*—David A. Scherbel
*Assistant Examiner*—Daniel Shanley
*Attorney, Agent, or Firm*—Fenwick & West LLP

[57] ABSTRACT

A system and method for securely clamping a target material that is to be manipulated using conventional machining techniques. The vise includes a single piece that includes a rigid jaw and a floating jaw that are integrally connected. The floating jaw is formed by a vertical and horizontal cut through a portion of the vise to enable the floating jaw to bend slightly in a hinge-like manner. A top portion of the rigid jaw and a top portion of the floating jaw are cut in a first pattern to form a working area. The size of the first pattern is approximately equal to the clamping surface of the target material. The size of the working area can be adjusted by securing devices that can expand the width of the working area to receive the target material and that can reduce the working area to securely clamp the target material. Additional cuts can be made in the vise to accommodate multiple target materials that can be secured independently. The vise of the present invention permits target parts to be securely gripped along the full length of its longitudinal axis, provides adequate clearance to machine tools to eliminate many interferences between the vise and the machining tool, enables multiple target parts to be secured independently, is adaptable to conventional machine tools, and increases the number of target parts that can be machined in a given space.

23 Claims, 5 Drawing Sheets

MACHINING VISE

BACKGROUND OF THE INVENTION

1. Field of the Invention

The present invention relates to the field of vises and more particularly to the field of machining vises.

2. Description of Background Art

Conventional vises are designed to hold a target part securely by having its jaws hold the target part in a work holding area. FIG. 8 is an illustration of a conventional single vise. A first jaw 802A of the two jaws of a conventional single vise is fixed while the other jaw (movable jaw 802B) is attached to a movable body 806 that moves along the vise frame 808 by using a handle 810. The movable jaw 802B is positioned and applies pressure on a target part in the work holding area 804 of the vise. The main work holding area 804 of conventional vises are small when compared to the total length of the vise. There are conventional vises that incorporate two main work holding areas (double vises). When a handle on these double vises is turned, two movable jaws can secure two target parts.

FIG. 9*a* illustrates an example of a target part 902 being secured by a conventional single vise. The long axis of the target part 902 is gripped by the jaws 802 in order to ensure that the target part is secure. The gripping force is parallel to the long axis of the vise. In contrast, if the target part 902 is aligned in parallel with the long axis of the vise the target part is not securely clamped as illustrated in FIG. 9*b*.

When machining target parts it is imperative that the target part be secure in order to precisely machine the target part, e.g., in order to cut, bore, mill, drill, tapping the target part. In addition, a non-secure target part can become loose and cause injury to nearby workers and/or damage the cutting tools and machine. The main working area of conventional vises is not large enough to accommodate large target parts securely and safely, e.g., target part 902. In addition, when doing multiple side work, conventional vises do not provide adequate space for machine tools to reach a target part whose width is significantly less that the width of the vise, see FIG. 9C for example. In addition, conventional vises are limited to securing at most two individual target parts in a vise.

What is needed is an apparatus that (1) permits target parts to be securely gripped along the full length of its longitudinal axis;(2) provides adequate clearance to machine tools to eliminate many interferences between the vise and the machining tool; (3) enables multiple target parts to be secured independently; (4) is adaptable to conventional machine tools; and (5) increases the number of target parts that can be machined in a given space.

SUMMARY OF THE INVENTION

The invention is a vise apparatus for securely clamping a target material that is to be manipulated using conventional machining techniques. The vise includes a single piece that includes a rigid jaw and a floating jaw that are integrally connected. The floating jaw is formed by a vertical and horizontal cut through a portion of the vise to enable the floating jaw to bend slightly in a hinge-like manner. A top portion of the rigid jaw and a top portion of the floating jaw are cut in a first pattern to form a working area. The size of the first pattern is approximately equal to the clamping surface of the target material. The size of the working area can be adjusted by securing devices, e.g., bolts or screws, that can extend the width of the working area to receive the target material and that can reduce the working area to securely clamp the target material.

Additional cuts can be made in the vise to accommodate multiple target materials that can be secured independently. In addition, the vise includes multiple dowel pin openings to enable the vise to be divided into several physically separate vises which can each be attached to a machining tool.

In alternate embodiments the cut jaws can include an insert that can be made of a material that is harder than the material of the vise so that the insert is more resistant to damage from the target part. The insert can also be made of material that is softer than the vise material in order to reduce damage to the target part when secured.

In another alternate embodiment, the rigid jaw and floating jaws can be made from two separate blocks of material. A rod inserted into a hole in the two blocks, which is parallel to the longitudinal axis of the vise, permits the floating jaws to rotate. This rotation enables the size of the working area to vary. Springs, bolts and/or a hydraulic push cylinder, for example, may provide the clamping force of the vise. Similarly, Springs, bolts and/or a hydraulic push cylinder, for example, may provide a vise opening force.

The vise of the present invention permits target parts to be securely gripped along the full length of its longitudinal axis while still providing adequate clearance between the vise and the machining tool, enables multiple target parts to be secured independently, is adaptable to conventional machine tools, and increases the number of target parts that can be machined in a given space.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digits of each reference number corresponds to the figure in which the reference number is first used.

Figures 1, 2:
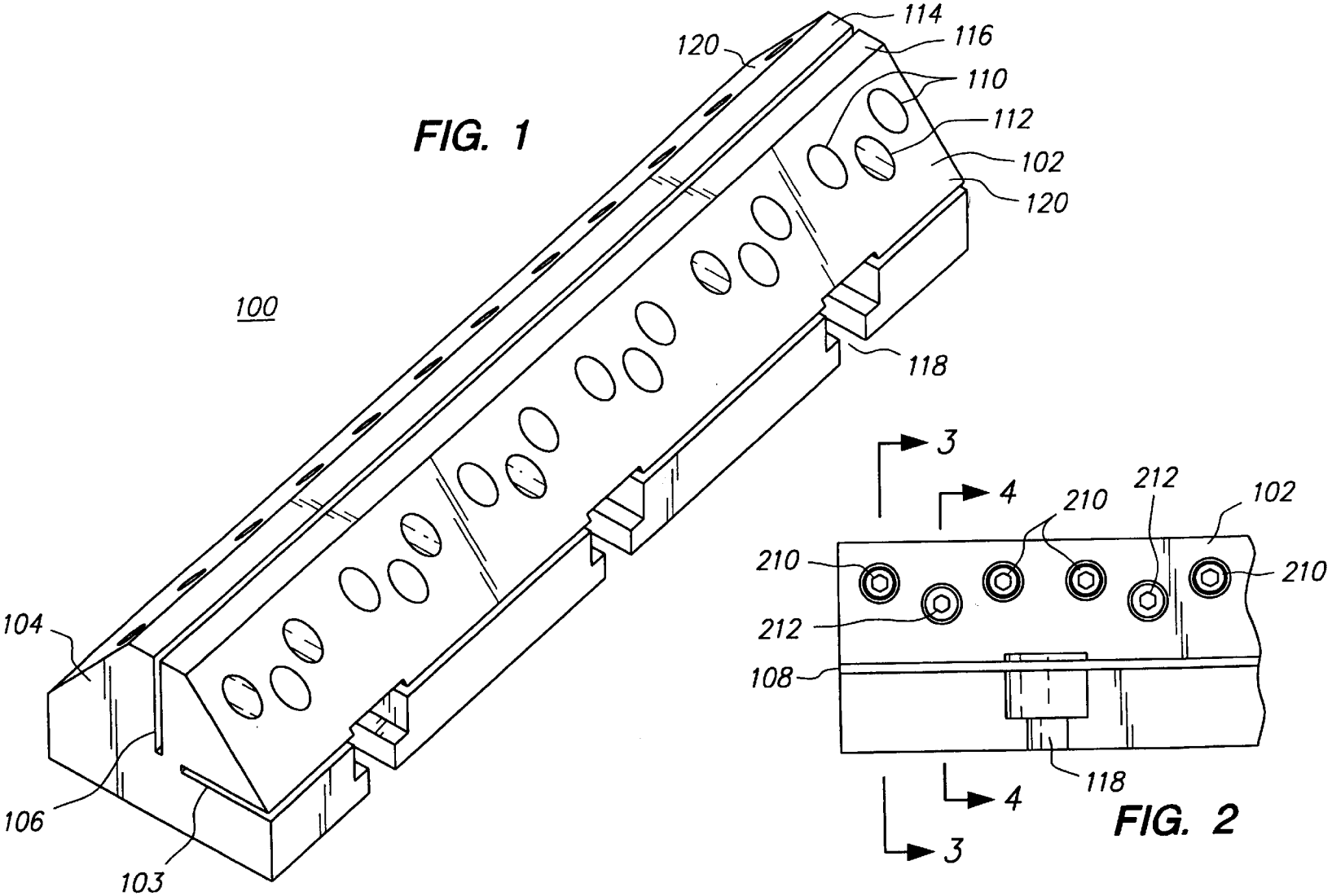
FIG. 1 is an illustration of the vise of the present invention in a top front, left side perspective view.
FIG. 2 is an illustration of the vise of the present invention in a side elevational view.

FIG. 1 is an illustration of the vise 100 of the present invention in a top front, left side perspective view. The vise 100 includes a floating jaw 102, a rigid jaw 104, a vertical cut 106, a horizontal cut 108, openings 110 for clamping bolts 210 (see FIG. 2), openings 112 for opening bolts 212 (see FIG. 2) securing openings 118, and a chamfer 120. The vise apparatus 100 securely clamps a target material (not shown) that is to be cut using conventional machining techniques. The vise 100 includes a single piece having a rigid jaw 104 and a floating jaw 102 that are integrally connected. In the preferred embodiment, the vise 100 is made of aluminum 6061. In alternate embodiments, the vise can be made of other hard metals, for example, aluminum 2024, aluminum 7075, steel, or other hard materials, e.g., plastics. In addition, the vise can be made of a combination of multiple materials.

The floating jaw 102 is formed by a vertical cut 106 and a horizontal cut 108 through a portion of the vise 100 to enable the floating jaw 102 to bend slightly in a hinge-like manner. In the preferred embodiment, a top portion of the rigid jaw 114 and a top portion of the floating jaw 116 are initially flat, as illustrated in FIG. 1. The vise having flat top portions 114, 116 can be delivered to a user, e.g., in a machining shop, and the top portions 114, 116 can be cut to a shape that will hold the target part. As described below, many shapes can be cut into the top portions 114, 116. Two of the many possible shapes that can be cut into the top portions 114, 116 are a single rectangular cut and multiple circular cuts. Examples of these two cuts are discussed below. It is envisioned that many other shapes and combinations of shapes can be formed by cutting the top portions of the jaws 114, 116. In alternative embodiments, the shapes are formed from having recesses (cuts) in only one of either the floating jaw or the rigid jaw.

FIG. 2 is an illustration of the vise 100 of the present invention in a side elevational view. Opening bolts 212 are illustrated in the openings for opening bolts 112. Clamping bolts 210 are illustrated in the openings for clamping bolts 110. The operation of the opening bolts 212 and clamping bolts 210 are now described with reference to FIG. 3 and FIG. 4.

Figure 3:
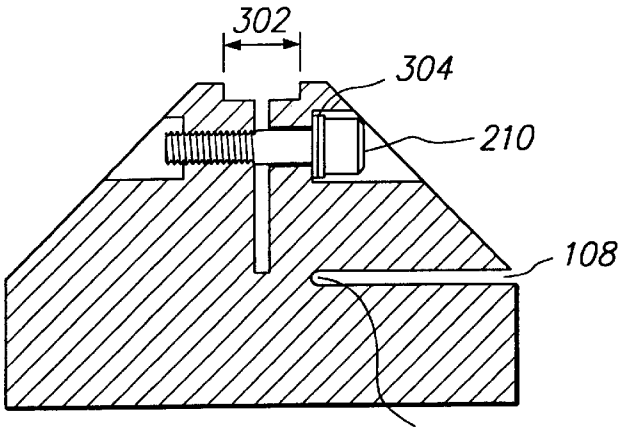
FIG. 3 is an illustration of the vise of the present invention in a cross-sectional front view illustrating a clamping bolt.

FIG. 3 is an illustration of the vise 100 of the present invention in a cross-sectional front view illustrating a clamping bolt 210. FIG. 3 also illustrates a rectangular working area 302 that is formed by a cut in the floating jaw 102 and a cut in the rigid jaw 104. The target part (not illustrated) is placed in the working area. As described above, in the preferred embodiment, the top portion of the jaws 114, 116 are cut such that the working area is approximately the size of a clamping surface of the target part. This enables the target part to be securely clamped with only minimal movement of the floating jaw 102. That is, the size of the working area is approximately equal to the size of the clamping surface when the vise is in an equilibrium state, e.g., when the jaw moving device (a bolt for example) is exerting no lateral pressure on said floating jaw and said rigid jaw.

The clamping bolt 210 illustrated in FIG. 3 is turned such that pressure on the floating jaw 102 is asserted by the head of the clamping bolt to force the floating jaw 102 to bend toward the rigid jaw. The threads of the clamping bolt 210 grip the rigid jaw 104. The size (width) of the working area decreases as the floating jaw 102 is forced toward the rigid jaw 104 causing the target part to be securely gripped within the cut of the top portion of the floating jaw 116 and the top portion of the rigid jaw 114.

In one embodiment, two washers 304, e.g., hardened steel washers, are positioned between the vise body and the bolt head. These washers help protect the vise body from damage due to the turning action of the bolt head 210. The washers 304 also function as simple bearings, this increases the efficiency of the vise when a clamping force is applied. The threads in the vise body may be standard threaded inserts.

One of the benefits of the present invention is that the force on the target part is applied perpendicular to the long axis of the vise (as opposed to being parallel to the long axis, as in conventional systems). Applying this clamping force in a direction perpendicular to the long axis of the vise enables the present invention to more securely clamp target parts. A second benefit of the present invention is that force is applied to a target part from both the floating jaw 102 and the rigid jaw 104 without significant deflection of the rigid jaw 104. In the preferred embodiment the force is generated by tightening the clamping bolts 210. This enables the vise to apply substantially even pressure from both jaws 102, 104 and reduces deflection of the jaws 102, 104 when compared to conventional systems.

Figure 4:
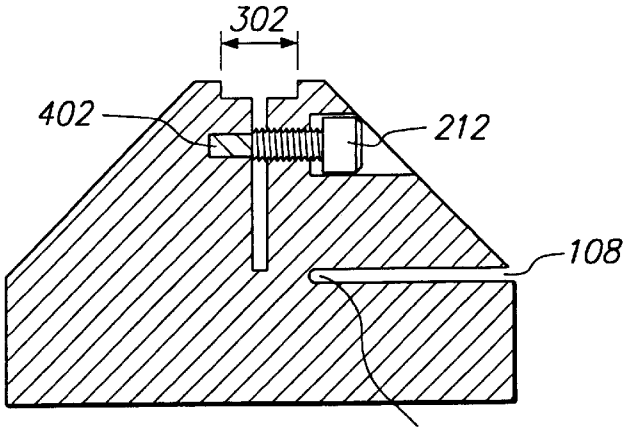
FIG. 4 is an illustration of the vise of the present invention in a cross-sectional front view illustrating an opening bolt.

FIG. 4 is an illustration of the vise 100 of the present invention in a cross-sectional front view illustrating an opening bolt 212. In order to increase the width of the working area 302, the user can unscrew the clamping bolt 210 and can also use the opening bolts 212 to further increase the width of the working area. The opening bolt 212 is turned through the opening for the opening bolt 212. The other end of the opening bolt 212 presses against a hardened steel insert 402 that is fitted into the rigid jaw 104 such that when the head of the opening bolt 212 is extended toward the rigid jaw 104 the floating jaw is forced to move away from the rigid jaw 104 due to the pressure exerted by the threads of the opening bolt 104. The result is that the width of the working area 302 increases. The ends of the opening bolts are modified to significantly match the radius in the steel insert to increase efficiency and reduce wear.

It is envisioned that other opening and closing methods can be used in place of, or in combination with, the above described embodiment. In one alternate embodiment, the floating jaw 102 may be connected to the rigid jaw 104 by a rod along the longitudinal axis of the vise 100. The floating jaw may be moved manually with screws (for example) or automatically, e.g., hydraulically, to adjust the size of the working area and to enable target parts to be easily clamped. The working area can be opened by using springs that are compressed, for example.

Figure 5:
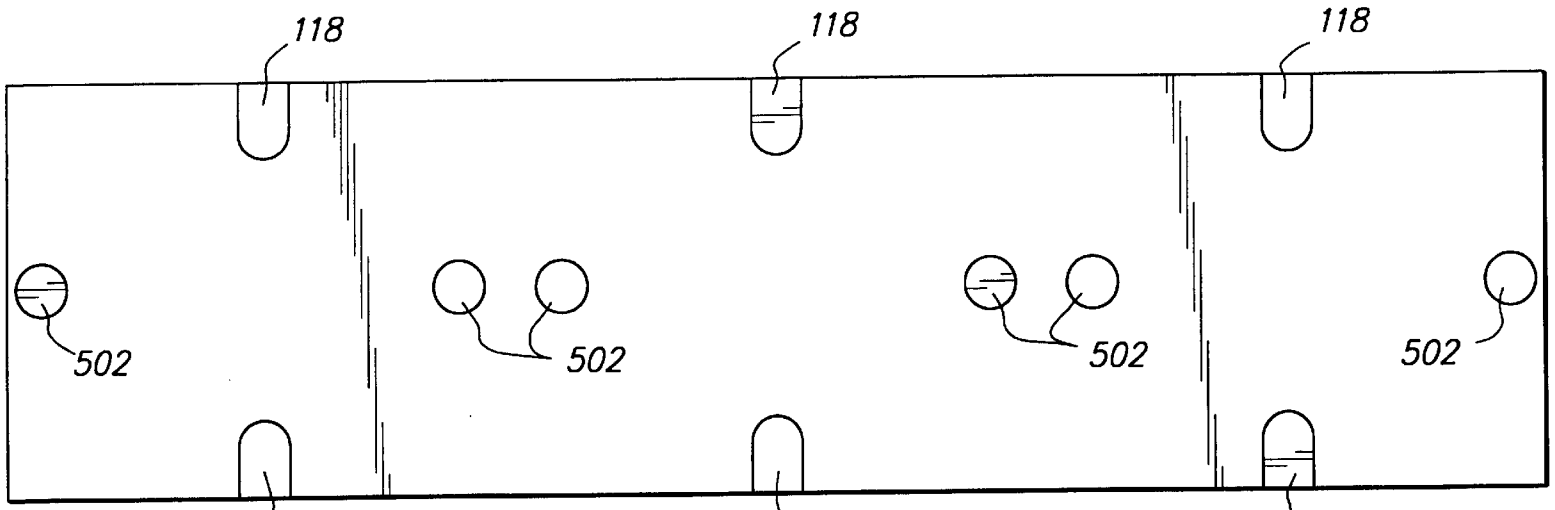
FIG. 5 is an illustration of the vise of the present invention in a base elevational view.

FIG. 5 is an illustration of the vise of the present invention in a base elevational view. The base of the vise 100 in the preferred embodiment includes six securing openings 118 and six locating holes 502. The securing openings 118 can receive a bolt and washer or a stud washer and nut from the top of the vise that secures the vise to the machining tool, for example. The locating holes can receive dowel pins, for example, to properly position the vise on the machine tool. After the vise 100 is properly secured and positioned on or in a machine tool (not shown) the jaws are cut, the target parts can then be secured in the working area 302 of the vise and the machine tool can machine the target part.

Figure 6:
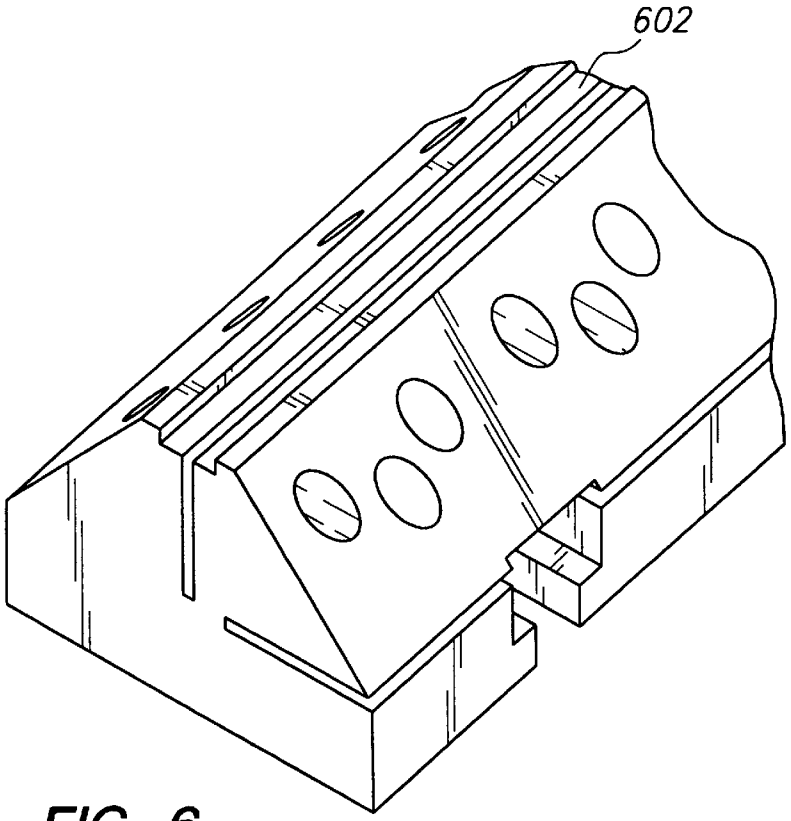
FIG. 6 is an illustration of the vise of the present invention in a top front, left side perspective view with a rectangular jaw cut along the longitudinal axis of the vise.
Figure 8:
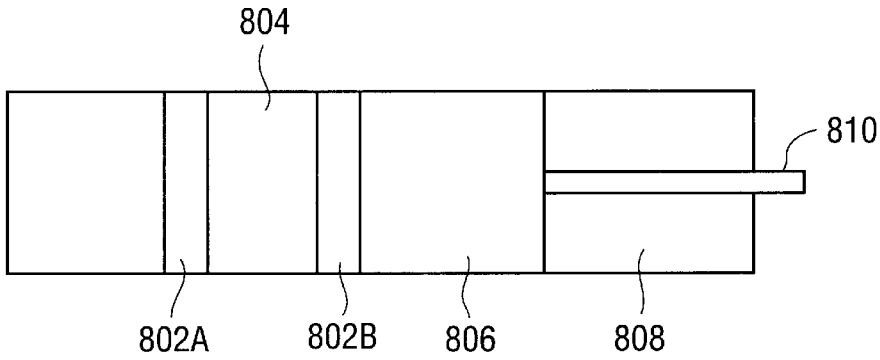
FIG. 8 is an illustration of a conventional vise.
Figure 9A:
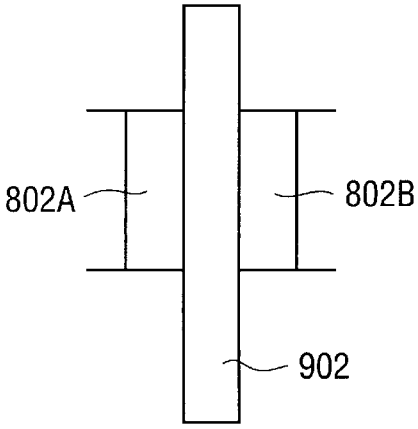
FIG. 9*a* is an illustration of target part held by a conventional vise in a first orientation.
Figure 9B:
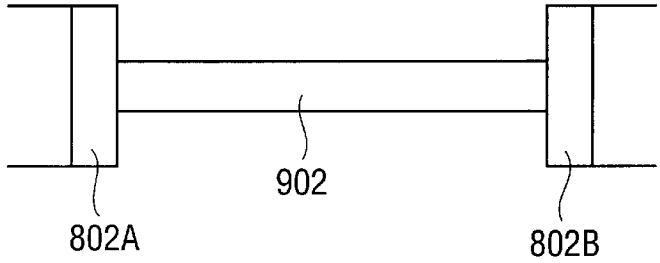
FIG. 9*b* is an illustration of target part held by a conventional vise in a second orientation.
Figure 9C:
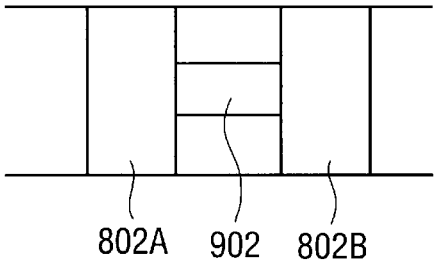
FIG. 9*c* is an illustration of target part held by a conventional vise.

FIG. 6 is an illustration of the vise 100 of the present invention in a top front, left side perspective view with a rectangular jaw cut along the longitudinal axis of the vise. As indicated above, the working area 602 of the vise illustrated in FIG. 6 is rectangular along the entire longitudinal axis of the vise 100. The shape of this working area 602 is based upon the shape of a clamping end of the target part. In this example, the clamping end of the target part would be rectangular. The target part would be secured in the working area 602 using one of the techniques described above.

Figure 7:
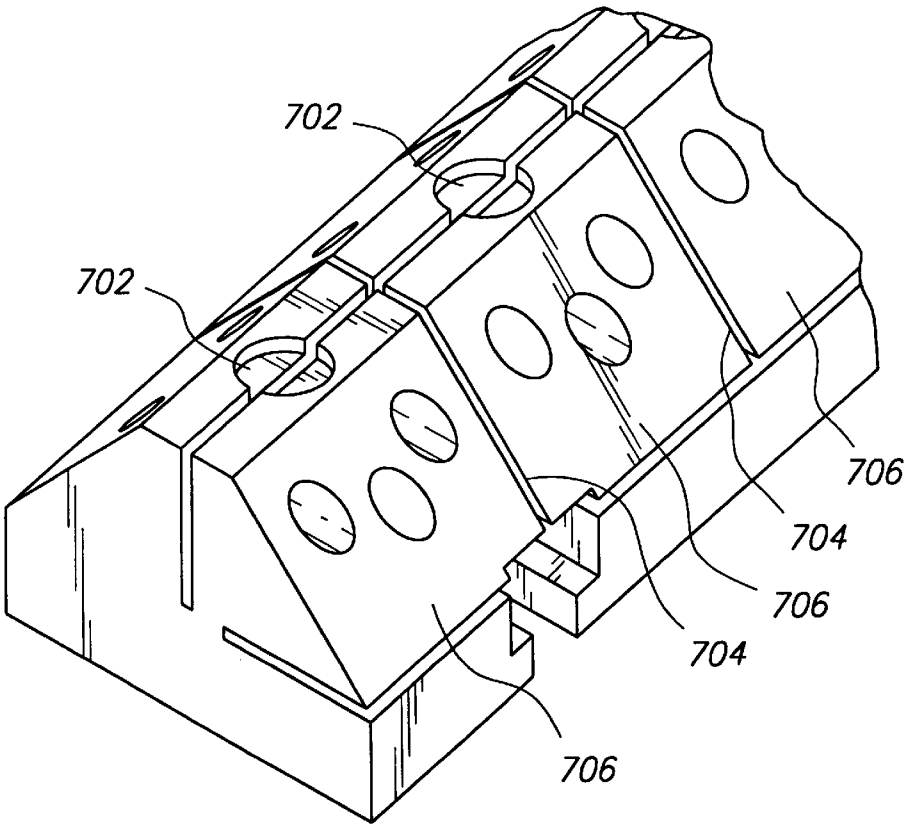
FIG. 7 is an illustration of the vise of the present invention in a top front, left side perspective view with several circular jaw cuts that can independently secure target parts.

FIG. 7 is an illustration of the vise 100 of the present invention in a top front, left side perspective view with several circular jaw cuts 702 that can independently secure target parts. In the example illustrated in FIG. 7, the shape of the working area 702 is circular. This example illustrates several of the benefits of the present invention. One benefit is that target parts having circular clamping ends can be easily secured using the present invention. Another benefit is that multiple target parts can be secured. In comparison, it is difficult to secure more than two objects in conventional vises. The vise 100 can also have several independent vise cuts 704 that enable each working area to be independently manipulated. This permits each sub-vise 706 to independently secure a separate target clamping end. In the illustration of FIG. 7 each sub-vise 706 includes two clamping bolts 210 and one opening bolt 212. That is, in FIG. 7 six sub-vises are present in the vise 100 which can independently secure up to six different target parts. The independent partial vise cuts 704 can be positioned to form as many as twelve independent sub-vises 706, where each sub-vise 706 includes one clamping bolt 210. In this example, the opening bolt 212 can be removed and 24 target parts can be secured.

In the preferred embodiment, the length of a vise 100 is approximately 15 inches. In the preferred embodiment, the securing openings 118 and the locating holes 502 are positioned such that the entire vise can be cut into up to three separate pieces. This permits five inch vises to be used on a machining tool. For example, if a machining tool can accept target parts along a twenty inch area, a fifteen inch vise can be secured adjacent to a five inch vise in the machining tool to maximize the efficiency of the machining operation. It is envisioned that in alternate embodiments the size of the vise 100 can differ significantly from the size of the vise 100 in the preferred embodiment.

In alternate embodiments the working area 302 can be formed by cutting a receiving shape into the portion of the jaws 114, 116 and inserting a working shape therein. The working shape would form the working area 302. A benefit of this embodiment is that if the working shape becomes worn or deformed from use, a replacement insert can be placed in the receiving shape. In addition, the insert can be made of material whose hardness can vary depending on the type of target part it is securing. For example, the insert can be made of steel, or the like, which could wear down at a slower rate than the aluminum that composes the vise 100 in the preferred embodiment. Alternatively, a plastic insert, or the like, could be used to provide a securing material that will not damage the target part.

In another alternate embodiment, the working area is formed from cutting a receiving shape into only one of the floating jaw 102 or the rigid jaw 104.

Another benefit of the vise 100 of the present invention is that the chamfers 120 of the floating jaw 102 and the rigid jaw have a clearance slant to permit target materials (parts) to be securely gripped along its longitudinal axis while also providing adequate clearance for machine tools. The clearance slant of the chamfers 120 eliminates many interference problems that can occur between the vise and the machining tool for single side and multiple side machining. For example, multiple sided work of a target part having the shape of long bars, using a horizontal machining center (or vertical mills with rotary tables) will benefit significantly from the present invention. The vise 100 substantially eliminates interference between the vise and the cutting tool or the tool holder. The vise is also effective for single sided work. For example, a machine tool having a 14 by 30 working area could hold seven vises, with each of the vise capable of holding target parts, at a fraction of the cost of a conventional double vise. For example, multiple sided machining can be accomplished using a 3-sided or 4-sided column. The shape of the vise of the preferred embodiment greatly reduces the vise/cutting tool interference, which is a major obstacle to efficient machining of multiple side target parts.

Given the minimum movement of the floating jaw 102, the potential for metal fatigue is low. The present invention has been tested with the hinge (floating jaw 102) being exposed to approximately 10,000 opening and closing cycles with a working area movement of approximately 0.02 inches, with no sign of metal fatigue. The end of horizontal cut 108 is rounded 306 to reduce metal fatigue while increasing the flexibility of the vise. This rounded end 306 can be part of any embodiment of the present invention The vise 100 of the present invention generates considerable clamping forces from only a modest amount of torque on the bolts. The vise comes with standard threaded insets for the clamping bolts 210 and the opening bolts 212 to prolong their useful duration even under stressful conditions.

Figure 10:
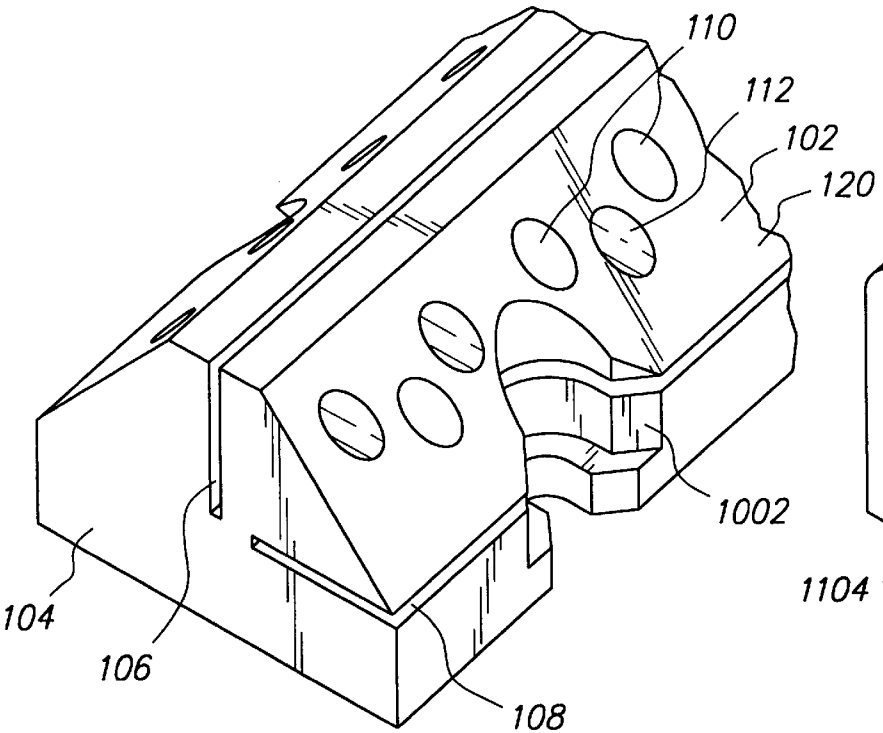
FIG. 10 is an example of an alternate embodiment of the present invention with the securing opening extending to the top of the vise.

FIG. 10 is an example of an alternate embodiment of the present invention with the securing opening extending to the top of the vise. The alternate embodiment includes a securing opening 1002 that extends through the rigid jaw 104 and the floating jaw 102. This securing opening permits a securing bolt to be positioned in the securing opening 1002 from the top of the vise. This enables multiple vises to be positioned with minimal spacing between adjacent vises, for example.

Figure 11:
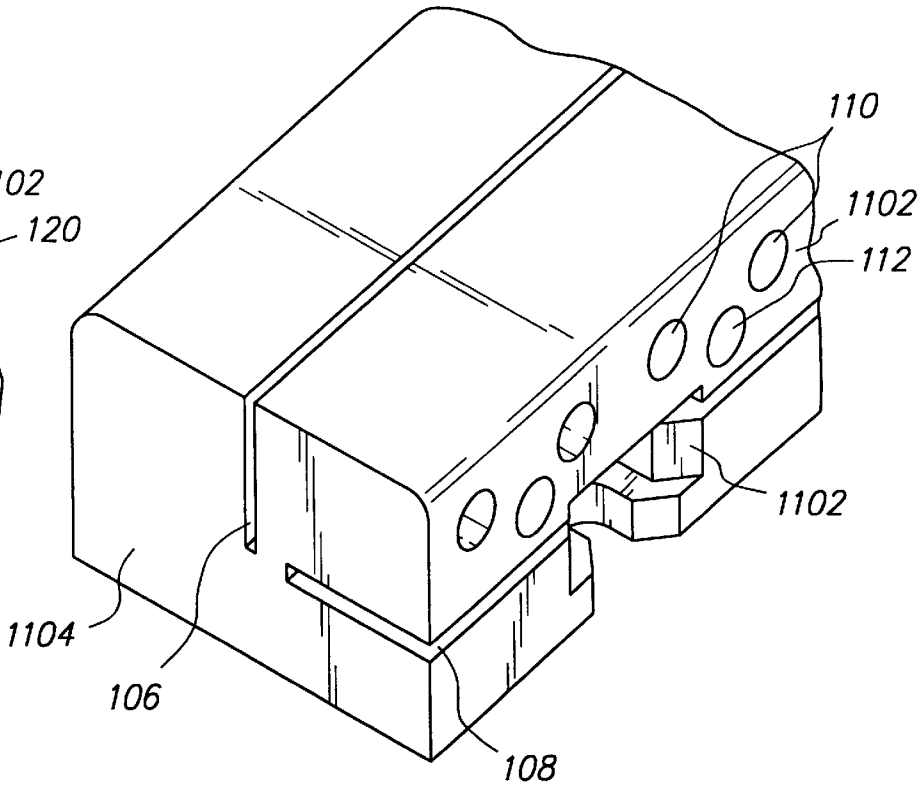
FIG. 11 is an example of another alternate embodiment of the present invention.

FIG. 11 shows an alternative securing opening 118 that does not extended to the top of the movable or rigid jaws. This permits the working area 302 to be unaltered by the securing openings 118.

In another embodiment, the vise includes a hinge coupled to the floating jaw and said rigid jaw to enable the movement of the floating jaw. The hinge may include a first plate coupled to the floating jaw, a second plate coupled to the rigid jaw and a rod coupled to the first and second plates where the first plate can move around the rod.

While the invention has been particularly shown and described with reference to a preferred embodiment and several alternate embodiments, e.g., various size and shapes of the vise to accept various size parts, it will be understood by persons skilled in the relevant art that various changes in form and details can be made therein without departing from the spirit and scope of the invention.

What is claimed is:

1. A vise having a long axis for securing a target part comprising:

a floating jaw, having a first recess in a first top portion; a rigid jaw, having a second recess in a second top portion; a vertical slit, extending from between said top of said floating jaw and said top of said rigid jaw to a first position at a bottom of said floating jaw; a horizontal slit, extending from a bottom side of said floating jaw to a second position, said second position adjacent to said first position, wherein a gap exists between said first and second positions; and wherein said first and second recesses form a working area for receiving the target part; and a jaw moving device for applying a force to said floating jaw in a direction perpendicular to the long-axis of the vise, such that said working area decreases to secure the target part.

2. The vise of claim 1, wherein said floating jaw and said rigid jaw are integrally formed from a first material.

3. The vise of claim 2, wherein said rigid jaw and said floating jaw secure the target part along a longitudinal axis of the target part.

4. The vise of claim 2, wherein said first recess and said second recess are cut from the vise material.

5. The vise of claim 4, wherein a width of said working area is approximately equal to a width of a clamping surface of the target part.

6. The vise of claim 4, where said width of said working area is approximately equal to said width of said clamping surface when said vise is in an equilibrium state.

7. The vise of claim 6, wherein said first material is aluminum.

8. The vise of claim 2, wherein said first material is aluminum.

9. The vise of claim 1, further comprising:

a first working area insert, positioned adjacent to said first recess;

a second working area insert, positioned adjacent to said second recess;

wherein said first and second working area inserts form said working area.

10. The vise of claim 9, wherein said first working area insert is removable from said floating jaw and said second working area insert is removable from said rigid jaw.

11. The vise of claim 9, wherein said first and second inserts are made of a material harder than said first material.

12. The vise of claim 9, wherein said first and second inserts are made of said first material.

13. The vise of claim 9, wherein said first and second inserts are made of a material softer than said first material.

14. The vise of claim 2, further comprising a third recess in said top portion of said floating jaw;

a fourth recess in said top portion of said rigid jaw;

wherein said third and fourth recesses form a second working area for receiving a second target part.

15. The vise of claim 14, wherein said floating jaw and said rigid jaw form a first sub-vise, said vise further comprising:

a second sub-vise including, a second floating jaw capable of having a third recess; and a second rigid jaw capable of having a fourth recess;

said second sub-vise integral to said first sub-vise;

a second jaw moving device, for moving said second floating jaw such that said second working area decreases to secure the second target part independent of securing said target part.

16. The vise of claim 15, further comprising:

a base, integral with said rigid jaw, having a plurality of securing openings to secure said vise; and locating holes, for positioning said vise.

17. The vise of claim 2, wherein a first external side of said floating jaw is tapered and wherein a second external side of said rigid jaw is tapered.

18. The vise of claim 1, further comprising:

a hinge, coupled to said floating jaw and said rigid jaw, to enable the movement of said floating jaw.

19. The vise of claim 18, wherein said hinge includes:

a first plate coupled to said floating jaw;

a second plate coupled to said rigid jaw; and a rod, coupled to said first and second plates;

wherein said first plate can move around said rod.

20. A vise having a long axis for securing a target part comprising:

a floating jaw, having a first recess in a first top portion; a rigid jaw having a first edge, wherein said first recess and said first edge forms a working area for receiving a target part; and a vertical slit, extending from between said top of said floating jaw and said top of said rigid jaw to a first position at a bottom of said floating jaw; a horizontal slit, extending from a bottom side of said floating jaw to a second position, said second position adjacent to said first position, wherein a gap exists between said first and second positions; and a jaw moving device for applying a force to said floating jaw in a direction perpendicular to the long-axis of the vise, such that said working area decreases to secure the target part.

21. The vise of claim 20, wherein said floating jaw and said rigid jaw are integrally formed from a first material.

22. A vise having a long axis for securing a target part comprising:

a floating jaw, having a first edge; a rigid jaw having a first recess in a first top portion; wherein said first recess and said first edge forms a working area for receiving a target part; and a vertical slit, extending from between said top of said floating jaw and said top of said rigid jaw to a first position at a bottom of said floating jaw; a horizontal slit, extending from a bottom side of said floating jaw to a second position, said second position adjacent to said first position wherein a gap exists between said first and second positions; and a jaw moving device for applying a force to said floating jaw in a direction perpendicular to the long-axis of the vise, such that said working area decreases to secure the target part.

23. The vise of claim 22, wherein said floating jaw and said rigid jaw are integrally formed from a first material.

* * * * *